US006593553B2

(12) United States Patent
Whitfield

(10) Patent No.: US 6,593,553 B2
(45) Date of Patent: Jul. 15, 2003

(54) HEATING COIL ASSEMBLY AND METHODS FOR ASSEMBLING THE SAME

(75) Inventor: Charles T. Whitfield, Columbus, MS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/106,721

(22) Filed: Mar. 26, 2002

(65) Prior Publication Data

US 2002/0139793 A1 Oct. 3, 2002

Related U.S. Application Data

(60) Provisional application No. 60/279,021, filed on Mar. 27, 2001.

(51) Int. Cl.[7] ..... H05B 3/06

(52) U.S. Cl. ..... 219/536; 219/532; 219/454.12; 219/459.1; 392/385; 174/138 J

(58) Field of Search ..... 219/536, 537, 219/542, 546, 532, 549, 454.11, 454.12, 458.1, 459.1, 468.1; 392/379, 380, 381, 382, 383, 384, 385; 338/286, 290, 304, 305, 317, 318; 174/138 J, 175

(56) References Cited

U.S. PATENT DOCUMENTS 4,250,399 A * 2/1981 King ..... 219/532
4,528,441 A * 7/1985 Seal et al. ..... 219/532
4,885,840 A * 12/1989 McManus ..... 174/138 J
5,093,558 A * 3/1992 Blystone et al. ..... 219/532
5,122,640 A * 6/1992 Holmes ..... 219/532
5,124,534 A * 6/1992 Williams et al. ..... 219/532
5,578,232 A * 11/1996 Engelke ..... 219/532
5,959,254 A * 9/1999 Martin, Sr. ..... 174/138 J
6,020,577 A * 2/2000 Barker ..... 219/537
6,509,554 B2 * 1/2003 Howard et al. ..... 219/536

* cited by examiner

*Primary Examiner*—Teresa Walberg
*Assistant Examiner*—Fadi H. Dahbour
(74) *Attorney, Agent, or Firm*—Howrey Simon Arnold & White LLP

(57) ABSTRACT

The present invention provides a heating coil assembly having metal bracket, a support rail, a heating coil, and a plurality of insulating supports. The metal bracket is attached to a terminal block and the support rail. The heating coil is electrically connected to the terminal block. Each insulating support has a hole to receive the support rail. Each insulating support further has a rigid body and a plurality of slots. Each slot is capable of receiving a portion of a coil turn of the heating coil. Each slot has a generally flat bottom and two inwardly projecting sidewalls. Each inwardly projecting sidewall is defined by a hook edge and ramp edge. The present invention further includes a method of assembling such heating coil assembly.

16 Claims, 6 Drawing Sheets

HEATING COIL ASSEMBLY AND METHODS FOR ASSEMBLING THE SAME

The present application claims priority from Provisional Application Serial No. 60/279,021 entitled "Heating Coil Assembly and Methods For Assembling The Same" filed Mar. 27, 2001, which is commonly owned and incorporated herein by reference in its entirety.

FIELD OF THE INVENTION

The present invention relates generally to heating coil assemblies and, more particularly, to a support for heating coil assemblies and methods for assembling the same.

BACKGROUND OF THE INVENTION

Electric heating elements using helical wire heating coils are well known in the art. A helical wire heating coil is typically mounted on a supporting structure and strung between a number of ceramic insulating elements which provide direct support for the coil and isolate the coil from the supporting structure which is generally some type of metal framework. If is important that the insulating element hold the coil against both lateral displacements out of the supporting member and movement in the direction of the axis of the coil. Thus, it is common in prior art ceramic insulating supports to capture one or more turns of the helical coil to hold the same against lateral displacements and axial movement.

A prior art heating coil assembly with insulating supports is shown in U.S. Pat. No. 5,122,640. There, the insulating support has notches that include lead-in ramp surfaces to spread two halves of the coil turn until the coil is centrally positioned in the notch. A portion of the coil turns rest on the faces of the support body to preclude axial movement of the coil once it is locked into position. The notch has four separate abutments to further prevent dislodgment. A problem with this construction is that a fair portion of the coil turn contacts the surface of the insulating support. Over time, after the coil is energized, hot spots will form at the locations where the coil makes contact with the insulating support. This may lead to uneven heating and reduces the life of the heating coil. Moreover, the support notches shown in U.S. Pat. No. 5,122,640 have an outer abutment means that project inwardly of the outer edge portion of the notch for engaging the outer surface of the coil turn. This forces the coil to be within the outer edges of the insulating support. This type of design along with the assembly layout inhibits good air circulation. The patent also shows that the assembly is held together by two separate rails.

A heating coil assembly is also shown in U.S. Pat. Nos. 248,943 and 4,250,399, which are owned by the assignee of the present invention and incorporated herein by reference in their entirety. The notches or slots shown in those patents require less contact between the heating coil and the insulating support. However, the insulating support described in those patents is used for heating coil assembly that requires more components and costs more to build and assemble.

The present invention is directed to overcoming, or at least reducing the effects of, one or more of the problems set forth above.

SUMMARY OF THE INVENTION

To that end, the present invention provides a heating coil assembly having a metal bracket, a support rail, a heating coil, and a plurality of insulating supports. The metal bracket is attached to a terminal block and the support rail. The heating coil is electrically connected to the terminal block. Each insulating support has a hole to receive the support rail. Each insulating support further has a rigid body and a plurality of slots. Each slot is capable of receiving a portion of a coil turn of the heating coil. Each slot has a generally flat bottom and two inwardly projecting sidewalls. Each inwardly projecting sidewall is defined by a hook edge and ramp edge.

The rigid body of the insulating supports may further have generally parallel front and rear faces. The flat bottom of each slot prevents the coil turn from contacting the generally parallel front and rear faces. The hook edge of the inwardly projecting sidewall is capable of engaging the inner surface of the coil turn. The ramp edge of the inwardly projecting sidewall assists in sliding the coil into the slot.

In another embodiment, the present invention provides an insulating support for a helical wire heating coil. The support includes a rigid body of insulating material and a plurality of first and second slots. The rigid body has an opening to receive a single support rail. The body further includes a first edge, a second edge, and generally parallel front and rear faces. The plurality of first slots are located on the first edge. The plurality of second slots are located on the second edge. Each of the first and second slots are capable of receiving a portion of a coil turn of the heating coil. Each of the first and second slots further include a generally flat bottom and two inwardly projecting sidewalls. The flat bottom of the slot prevents the coil turn from contacting the generally parallel front and rear faces of the body. Each inwardly projecting sidewall is defined by a hook edge and a ramp edge.

In further embodiment, the present invention includes a method of assembling a heating coil assembly. The method includes providing a support rail, a terminal block, a plurality of insulating supports, and a heating coil. The support rail has a longitudinal body and a bracket portion. The longitudinal body has a plurality of tabs. The terminal block has a bracket portion. The plurality of insulating supports have at least one slot and a hole. The method further includes: attaching the bracket portion of the support rail to the bracket portion of the terminal block; inserting the longitudinal body of the support rail in each hold of the insulating support; bending the plurality of tabs on the longitudinal body of the support rail to prevent axial movement of the insulating supports along the support rail; placing a turn of the heating coil in each slot of the insulating supports; and electrically connecting the heating coil to the terminal block.

The above summary of the present invention is not intended to represent each embodiment, or every aspect of the present invention. This is the purpose of the figures and detailed description which follow:

BRIEF DESCRIPTION OF THE DRAWINGS

Other objects and advantages of the invention will become apparent upon reading the following detailed description and upon reference to the drawings.

Figure 1:
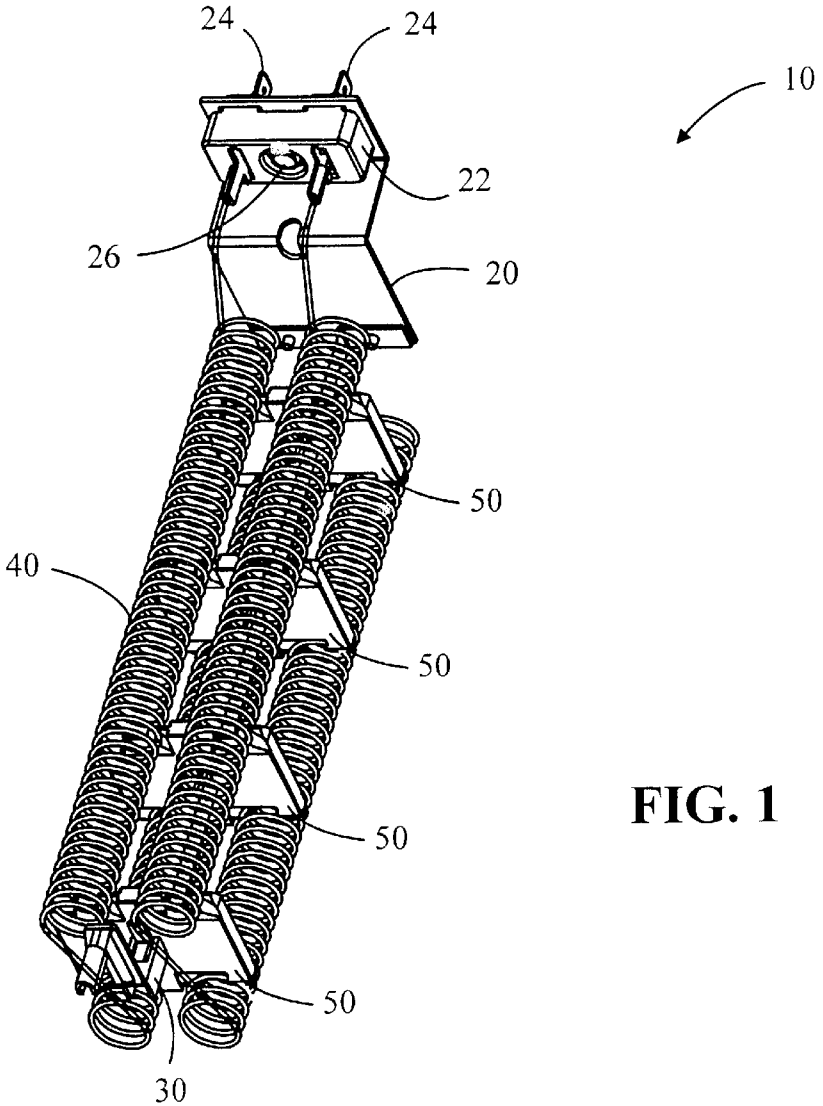
FIG. 1 is a perspective view of a heating coil assembly according to the present invention.
Figure 2:
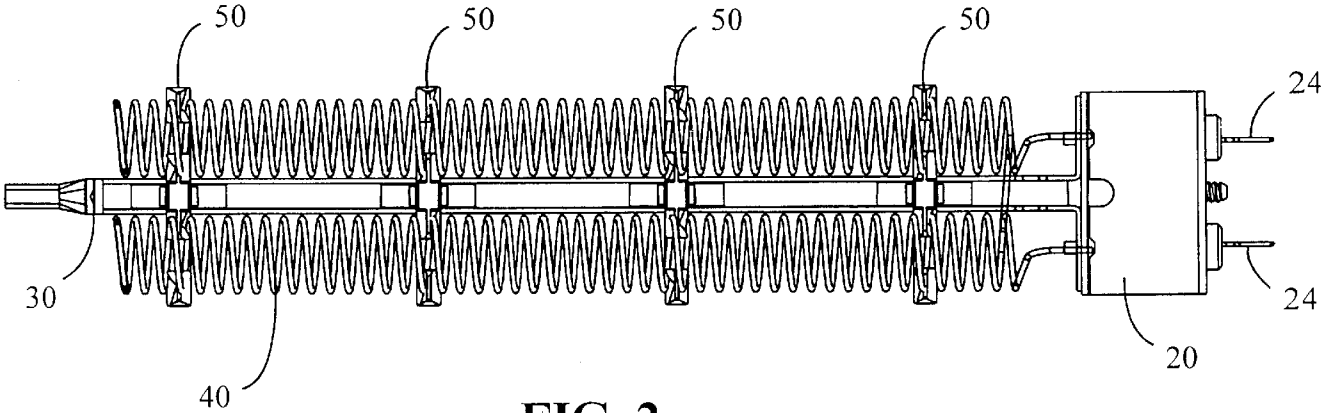
FIG. 2 is a bottom view of the heating coil assembly shown in FIG. 1.
Figure 3:
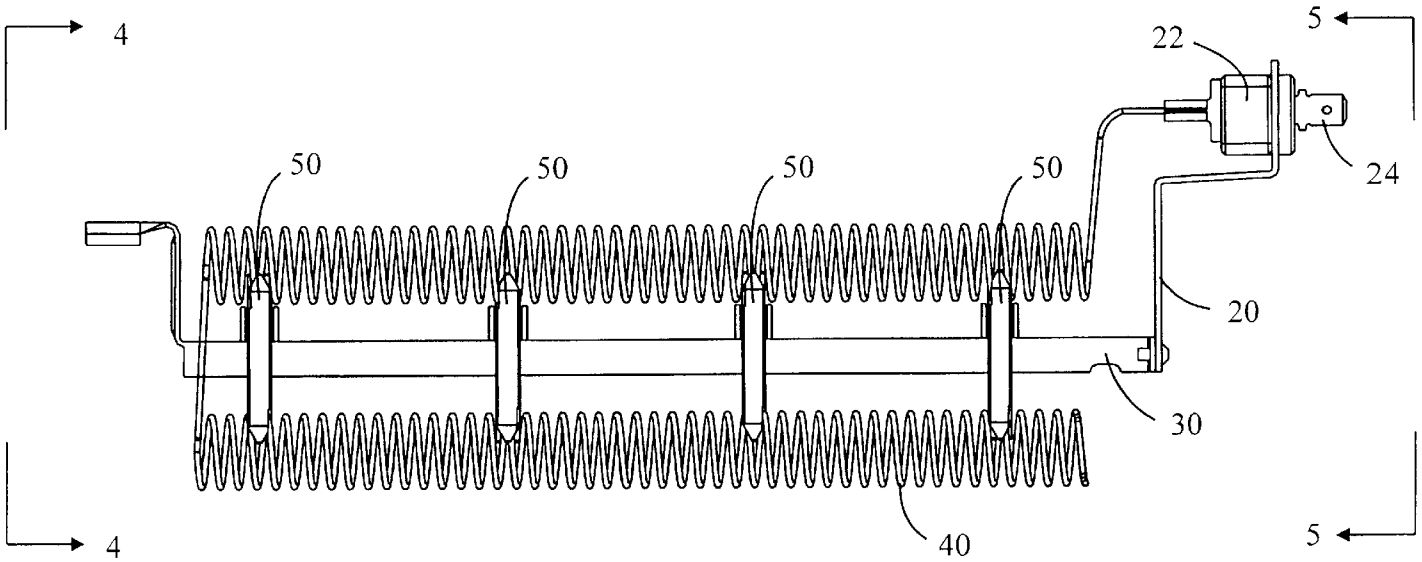
FIG. 3 is a side view of the heating coil assembly shown in FIG. 1.
Figure 5:
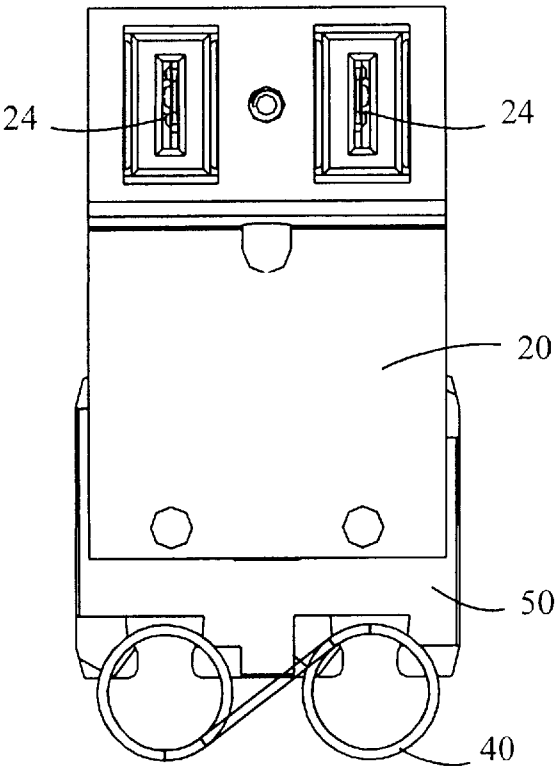
FIGS. 4 and 5 are end views of the heating coil assembly shown in FIG. 1.
Figure 4:
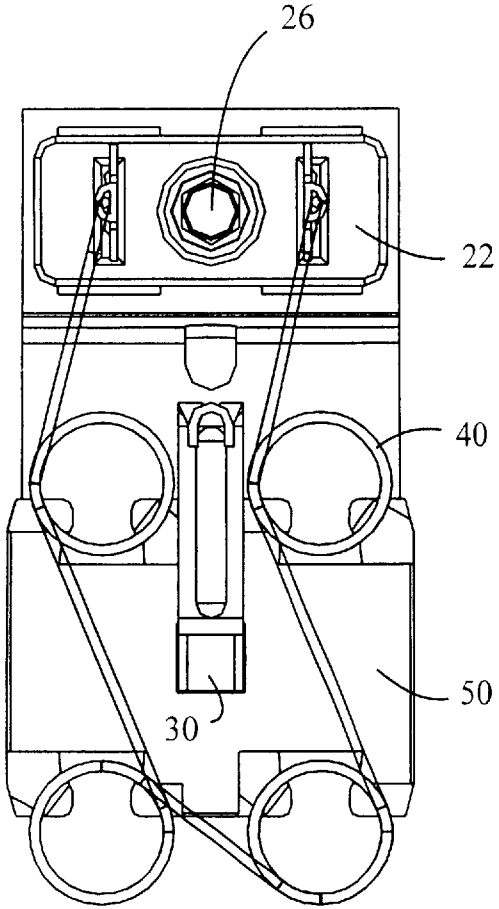
Figure 6:
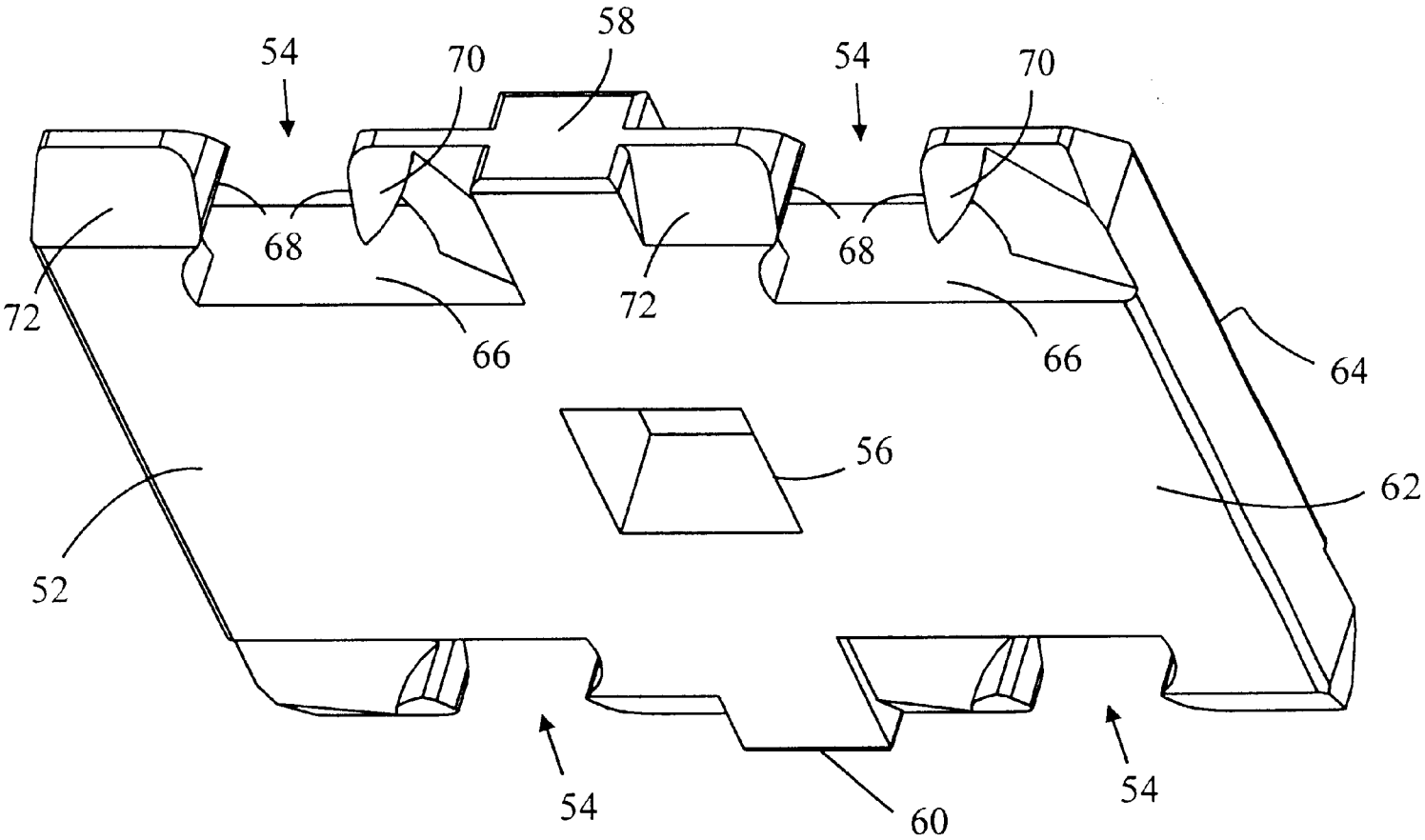
FIG. 6 is a perspective view of an insulating support for a heating coil assembly according to the present invention.
Figure 7B:
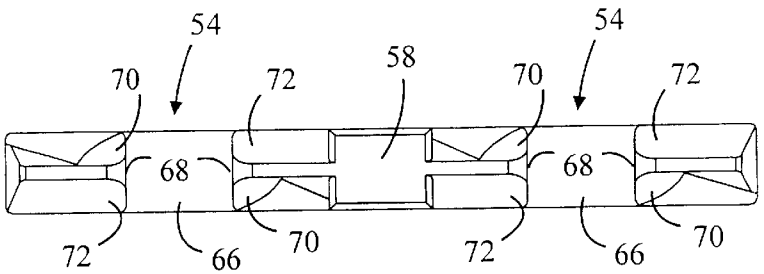
FIGS. 7A–7C are side, top and end views of the insulating support shown in FIG. 6.
Figure 7A:
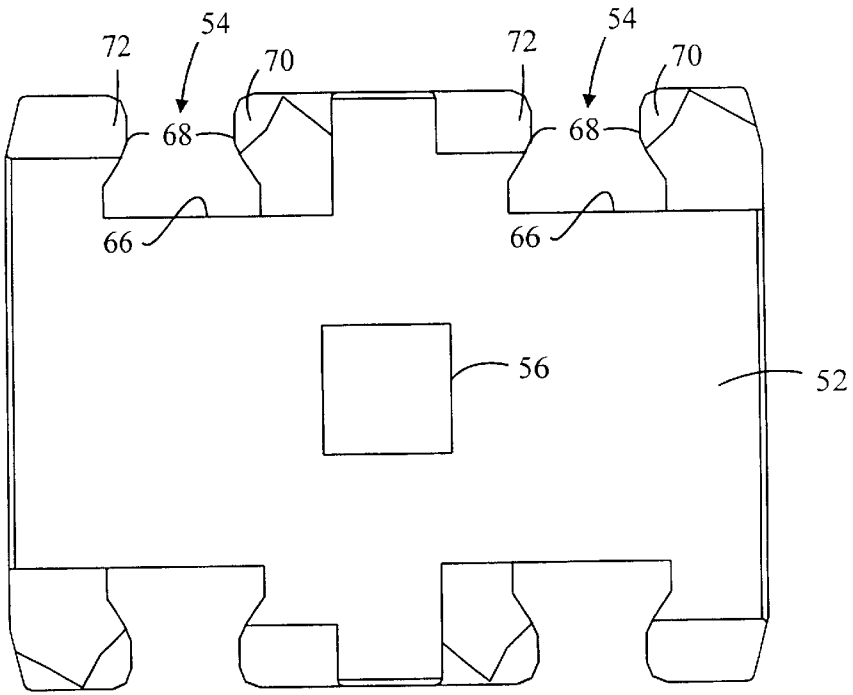
Figure 7C:
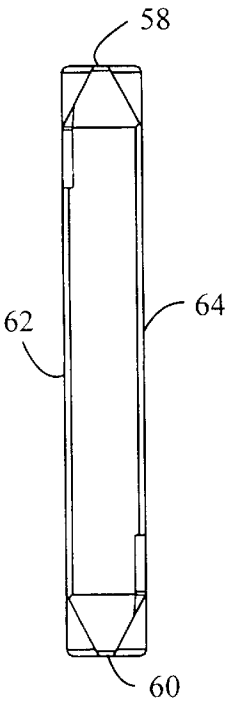

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF PREFERRED EMBODIMENTS

Turning to the drawings, FIGS. 1–5 depict one embodiment of a heating coil assembly 10 according to the present invention. The heating coil assembly includes a sheet-metal bracket 20, a support rail 30, a heating coil 40, and a plurality of insulating supports 50. Attached to the metal bracket 20 is a terminal block 22. The terminal block 22 may be made of a rigid insulating material such as a ceramic. The terminal block 22 supports terminals 24 and provides electrical connection between the heating coil 40 and a power source (not shown). The terminal block 22 may be attached to the metal bracket 20 by a screw or bolt 26.

The metal bracket 20 is also attached to the support rail 30. The support rail 30 is preferably made of metal and is used to support the plurality of insulating supports 50. The metal bracket 20 and the support rail 30 may be mounted on any suitable support. In one embodiment, the heating coil 40 is a single coiled wire that attaches to each of the insulating supports 50. In this embodiment, four insulation supports 50 are used. The present invention is not limited to this number of supports 50 and it is contemplated that a greater or lesser number may be required based on the specific application for the coil heater assembly 10. The insulating supports 50 insulate the coiled heating wires from the metal support rail 30 and the metal bracket 20.

FIGS. 6 and 7A–7C illustrate an embodiment of an insulating support 50 according to the present invention. The insulating support 50 is formed of molded ceramic material or any other suitable rigid insulating material. In this embodiment, the insulating support 50 includes a rigid body 52, a plurality of slots 54, and an opening 56. The rigid body 52 has a first edge 58, a second edge 60, and a generally parallel front face 62 and rear face 64. The plurality of slots 54 are located on the first edge 58 and the second edge 60. Each slot is capable of receiving a portion of a coil turn of the heating coil 40 and locking the heating coil 40 against lateral and axial movement in the slot 54.

Each slot 54 has a generally flat bottom 66 and inwardly projecting sidewall 68. The flat bottom 66 prevents the coil turn from contacting the generally parallel front face 62 and the rear face 64 of the rigid body 52. Each inwardly projecting sidewall 68 has a hook edge 70 and a ramp edge 72. The hook edge 70 is used to engage the inner surface of a coil turn of the heating coil 40. The ramp edge 72 is used to assist in sliding the coil turn into the slot 54.

When the heating coil 40 is mounted in the slots 54, the axis of the coil 40 extends generally perpendicular to the faces 62 and 64 of the rigid body 52. The design of the slot 54 does not interfere with the natural pitch of the heating coil 40. The design also allows easy insertion of the heating coil 40 by rolling the coil 40 into the slot 54. Moreover, the insulating support 50 allows improved air flow over the heating coil 40 at the points where the coil 40 contacts the insulating support 50. It is noted that less than 30% of a turn of the heating coil 40 contacts the insulating support 50. This eliminates hotspots and creates a more uniform heat pattern along the heating coil 40. The elimination of hotspots also prolongs the life of the heating coil 40.

When the heating coil 40 has been fully inserted into the slot 54, the coil turn is captured and locked at two points-the two hook edges 70 of the slot 54. In addition, the heating coil 40 is prevented from sliding over the faces 62 and 64 of the body 52 by the flat bottom 66.

Figure 8:
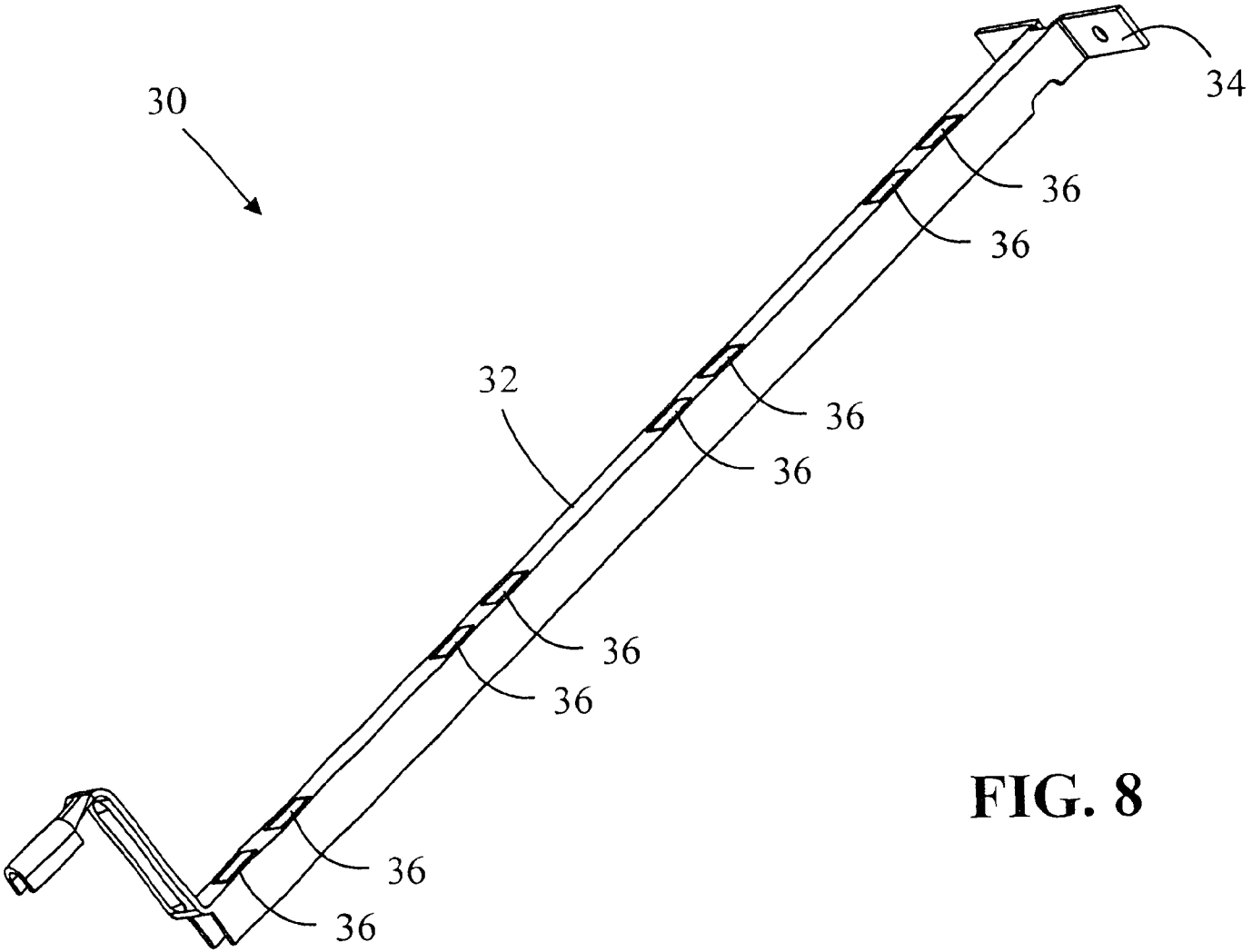
FIG. 8 is a perspective view of a support rail for a heating coil assembly according to the present invention.

The opening 56 of the insulating support 50 is used to receive and attach to the support rail 30. FIG. 8 illustrates an embodiment of a support rail 30 according to the present invention. The support rail 30 has a longitudinal body portion 32 and a bracket portion 34. The longitudinal body potion 32 has a plurality of tabs 36 that are capable of being bent in the upward direction. The insulating supports 50 are equally spaced along the longitudinal body portion 32 of the support rail 30. To prevent axial movement of the insulating supports 50 along the longitudinal body portion 32, the tabs 36 are turned upward during the assembly process to hold the insulating supports 50 in position. The bracket portion 34 of the support rail 30 is used for attaching the support rail 30 to the metal bracket 20. The bracket portion 34 may be bolted, screwed or welded to the metal bracket 20.

The present invention also includes a method for assembling a heating coil assembly 10. In one embodiment, the method includes providing a support rail 30, a terminal block 22, a plurality of insulating supports 50, and a heating coil 40. The support rail 30 has a longitudinal body 32 and a bracket portion 34. The longitudinal body 32 has a plurality of tabs 36. The terminal block 22 has a bracket portion 20. The plurality of insulating supports 50 have at least one slot 54 and a hole 56. The method further includes: attaching the bracket portion 34 of the support rail 30 to the bracket portion 20 of the terminal block 22; inserting the longitudinal body 32 of the support rail 30 in each hole 56 of the insulating support 50; bending the plurality of tabs 36 on the longitudinal body 32 of the support rail 30 to prevent axial movement of the insulating supports 50 along the support rail 30; placing a turn of the heating coil 40 in each slot 54 of the insulating supports 50; and electrically connecting the heating coil 40 to the terminal block 22. The assembly method described above is not limited to these number or order of steps. One of ordinary skill in the art, having the benefit of the present application, would realize that additional steps may be taken or the steps may be done in a different order without departing from the spirit and scope of the present invention.

While the present invention has been described with reference to one or more particular embodiment, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A heating coil assembly comprising:

a metal bracket having a terminal block;

a support rail attached to the metal bracket;

a heating coil electrically connected to the terminal block; and a plurality of insulating supports, each insulating support having a hole, the support rail extending through each hole and being attached to the insulating support, wherein each insulating support has a rigid body and a plurality of slots, each slot capable of receiving a portion of a coil turn of the heating coil, each slot having generally flat bottom and two inwardly projecting sidewalls, each inwardly projecting sidewall defined by a hook edge and a ramp edge.

2. The heating coil assembly of claim 1, wherein the rigid body of the insulating supports have generally parallel front and rear faces, the flat bottom of each slot capable of preventing the coil turn from contacting the generally parallel front and rear faces.

3. The heating coil assembly of claim 1, wherein the hook edge of the inwardly projecting sidewall is capable of engaging the inner surface of the coil turn.

4. The heating coil assembly of claim 1, wherein the heating coil assembly has four insulating supports equally spaced along the support rail.

5. The heating coil assembly of claim 1, wherein less than thirty percent of the coil turn positioned in each slot makes contact with the insulating support.

6. The heating coil assembly of claim 1, wherein said heating coil is a single coiled wire.

7. The heating coil assembly of claim 1, wherein said heating coil is a helical coil.

8. The heating coil assembly of claim 1, wherein said insulating support is made of a ceramic material.

9. The heating coil assembly of claim 1, wherein said support rail includes a body portion having at least one tab and a bracket portion.

10. The heating coil assembly of claim 9, wherein said tabs prevent axial movement of said insulating supports.

11. An insulating support for a helical wire heating coil, the support comprising:

a rigid body of insulating material having an opening to receive a single support rail, the body further having a first edge, a second edge, and generally parallel front and rear faces; and a plurality of first slots located on the first edge and a plurality of second slots located on the second edge, each of the first slots and second slots capable of receiving a portion of a coil turn of the heating coil, wherein each of the first slots and second slots have a generally flat bottom and two inwardly projecting sidewalls, the flat bottom capable of preventing the coil turn from contacting the generally parallel front and rear faces of the body, each inwardly projecting sidewall defined by a hook edge and ramp edge.

12. The insulating support of claim 11, wherein the opening in the rigid body is a hole located in the center of the rigid body.

13. The insulating support of claim 11, wherein the hook edge of the inwardly projecting sidewall is capable of engaging the inner surface of the coil turn.

14. The insulating support of claim 11, wherein less than thirty percent of the coil turn positioned in each slot makes contact with the insulating support.

15. The insulating support of claim 11, wherein said insulating support is made of a ceramic material.

16. A method for assembling a heating coil assembly, the method comprising:

providing a support rail having a longitudinal body and a bracket portion, the longitudinal body having a plurality of tabs;

providing a terminal block having a bracket portion;

attaching the bracket portion of the support rail to bracket portion of the terminal block;

providing a plurality of insulating supports, each insulating support having a slot and a hole;

inserting the longitudinal body of the support rail in each hole of the insulating supports;

bending the plurality of tabs on the longitudinal body of the support rail to prevent axial movement of the insulating supports along the support rail;

providing a heating coil;

placing a turn of the heating coil in each slot of the insulating supports; and electrically connecting the heating coil to the terminal block.

* * * * *